US008029243B2

(12) United States Patent
Wang

(10) Patent No.: US 8,029,243 B2
(45) Date of Patent: Oct. 4, 2011

(54) LOCKING PLATE FAST FASTENING CEILING FAN BLADES

(75) Inventor: Cliff Wang, Tanzih Township, Taichung County (TW)

(73) Assignee: Air Cool Industrial Co., Ltd., Taichung (TW)

( * ) Notice: Subject to any disclaimer, the term of this patent is extended or adjusted under 35 U.S.C. 154(b) by 398 days.

(21) Appl. No.: 12/436,207

(22) Filed: May 6, 2009

(65) Prior Publication Data

US 2010/0284821 A1 Nov. 11, 2010

(51) Int. Cl.
*F04D 29/00* (2006.01)

(52) U.S. Cl. ..... 416/244 R; 461/210 R; 461/220 R

(58) Field of Classification Search ..... 416/244, 416/210 R, 214 R, 204 R, 206–207, 244 R, 416/220 R, 246
See application file for complete search history.

(56) References Cited

U.S. PATENT DOCUMENTS

| | | | | |
|---|---|---|---|---|
| 6,171,059 | B1 * | 1/2001 | Bucher et al. | 416/210 R |
| 6,821,091 | B2 * | 11/2004 | Lee | 416/210 R |
| 6,935,842 | B2 * | 8/2005 | Tai | 416/210 R |
| 7,351,037 | B1 * | 4/2008 | Mares et al. | 416/210 R |
| 7,527,478 | B2 * | 5/2009 | Pearce | 416/210 R |
| 2002/0054816 | A1 * | 5/2002 | Bucher et al. | 416/210 R |
| 2004/0219023 | A1 * | 11/2004 | Bird et al. | 416/210 R |
| 2005/0123403 | A1 * | 6/2005 | Tai | 416/210 R |
| 2007/0269314 | A1 * | 11/2007 | Pearce | 416/210 R |
| 2010/0124504 | A1 * | 5/2010 | Yao | 416/210 R |
| 2011/0158812 | A1 * | 6/2011 | Lu | 416/210 R |

* cited by examiner

*Primary Examiner* — Thanh Nguyen
(74) *Attorney, Agent, or Firm* — Ming Chow; Sinorica, LLC

(57) ABSTRACT

A locking plate fast fastening ceiling fan blades is provided where several nicks are formed, and a thru hole is formed communicating with the open side of one of the nicks. A wedge unit is provided in the thru hole of the locking plate. Thus, when a blade is installed on the blade rack, only the blade is set around the pillars of the blade rack, then the locking plate is made to wedge to the pillar of blade rack, and the wedge unit is made to stay close to and pass through the pillar in the nick communicating with the thru hole for fast and exact completion of fixing of the blade onto the blade rack.

5 Claims, 6 Drawing Sheets

LOCKING PLATE FAST FASTENING CEILING FAN BLADES

BACKGROUND OF THE INVENTION

1. Field of the Invention

This invention relates to a locking plate fast fastening ceiling fan blades.

2. Description of the Related Art

In order to prevent the fact that the blades of a conventional ceiling fan is collided to deviate the preset angle of the blades, when the blades are shipped, and thus that the installed ceiling fan causes noise and even wobbles when operating, the body of ceiling fan and a blade rack are in advance installed on the ceiling, and then the several blades are locked onto the blade rack of the body, the effects of easy shipment, preservation, and installation being further achievement.

However, the blade of conventional ceiling fan is definitely long as a rule and a front end of the blade is generally locked; it is not easily installed. In order to solve the defects, a locking device fastening the ceiling fan blades as disclosed in U.S. Pat. No. 6,652,236 is developed in the market. In this disclosure, the device is mainly provided with a clamp plate. Several apertures are formed on the clamp plate and an elongate retaining portion is formed around each of the apertures. The elongate retaining portion is connected to each of the opposite apertures. Further, retainer spring tab is provided around one of the apertures on the clamp plate. Thus, at the time of installation, only the apertures of the clamp plate align with and connect to the monitoring posts of the blade rack. Then, the clamp plate is pushed forwards to make the mounting posts locate in the elongate retaining portion, and the retainer spring tab is made to push down one of the mounting posts for completion of fast and exact installation. Further, for example, a locking device fastening the ceiling fan blades, which is disclosed in U.S. Pat. No. 5,593,283 is mainly provided with an annular spider. Four openings are formed at an equal angle around on the spider. The openings are formed with larger openings and smaller openings. Besides, a spring steel lock member is provided covering the openings. Thus, at the time of installation, only the openings of the clamp plate align with and connect to the monitoring posts of the blade rack. Then, the clamp plate is turned counterclockwise to locate the mounting posts in the smaller openings and make the spring steel lock member stay close to the sides of mounting posts for fast completion of installation of the blade.

However, the spring steel lock member of the device fast installed is fixed with rivets on the clamp plate. After it services for a long time, the fixed portion is easily deformed and then a gap is formed, causing the ceiling fan to make noises and wobble when the fan operates, and even seriously making the operating blades fall off during operation because the spring steel lock member has no elasticity; thus, it is apparent that improvement is necessarily made.

Consequently, because of the technical defects of described above, the applicant keeps on carving unflaggingly through wholehearted experience and research to develop the present invention, which can effectively improve the defects described above.

SUMMARY OF THE INVENTION

A locking plate fast fastening ceiling fan blades according to the present invention is provided, and three triangular nicks are formed around the circumference of locking plate and wedged onto the pillar of a blade. A thru hole is formed communicating with the open side of nick in the center of locating plate. A wedge unit is provided in the thru hole. The wedge unit is a wedge spring plate. One side of the wedge spring plate is a fixing terminal and connects to the clamp plate; the other side is formed with a free terminal upwards warping toward the open side of nick. The free terminal lies at the open side of nick. Thus, when a set of blades is installed on the blade rack, only the blade is set around the pillars of the blade rack, then the locking plate is made to wedge to the sides pillars, and the free terminal of wedge spring plate is made to stay close to and pass through the pillar in the nick for fast and exact completion of fixing of the blade onto the blade rack.

DETAILED DESCRIPTION OF THE PREFERRED EMBODIMENTS

Now, the present invention will be described more specifically with reference to the following embodiments. It is to be noted that the following descriptions of preferred embodiments of the present invention are presented herein for purpose of illustration and description only; it is not intended to be exhaustive or to be limited to the precise form disclosed.

Figure 1:
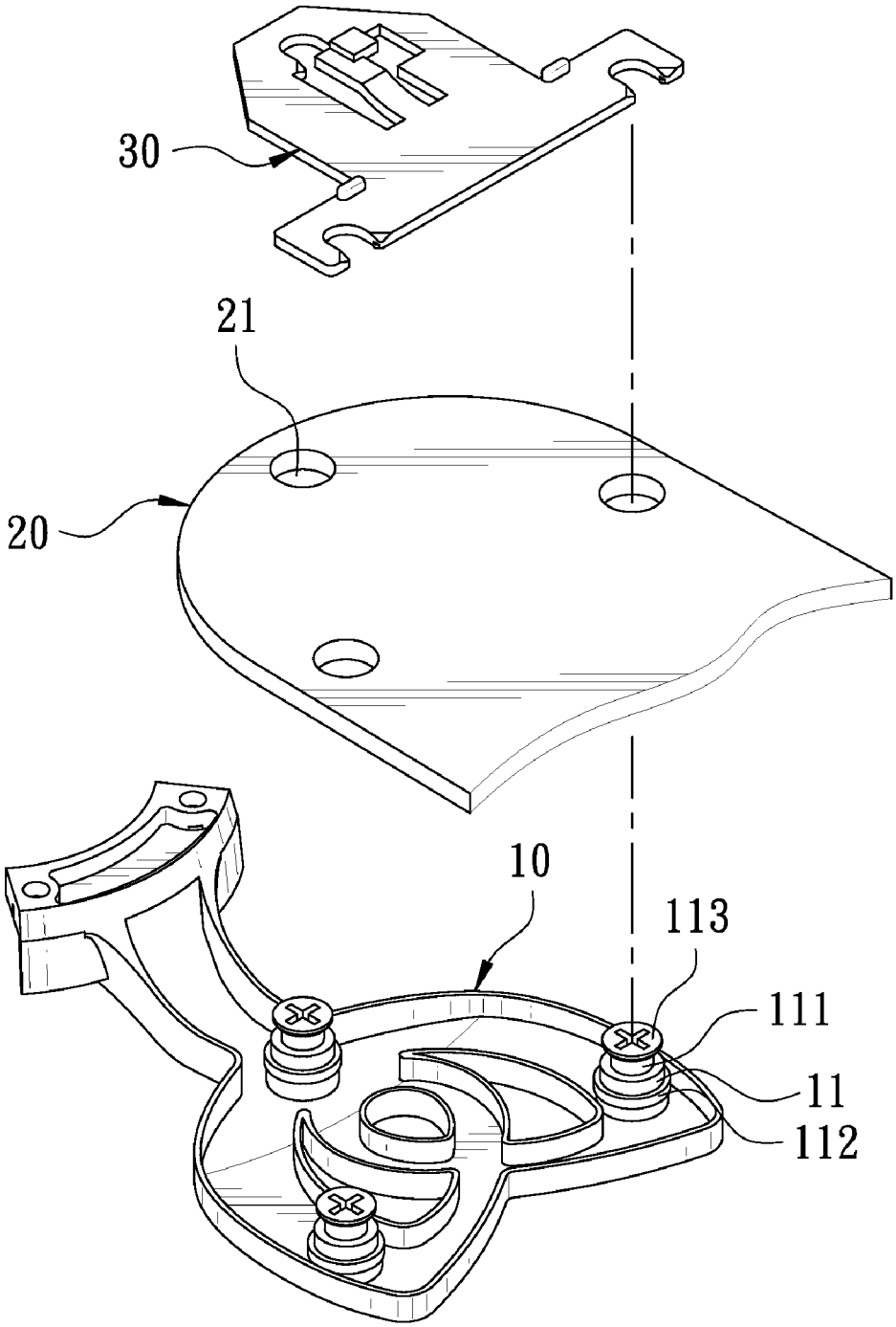
FIG. 1 is a 3D view of a carpentry-based dust collector according to the present invention in preferred embodiment.

With reference to FIG. 1 shown as a 3D exploded view of a preferred embodiment of this invention, a locking device mainly comprises a blade rack 10, a blade 20, and a locking plate 30. On the blade rack 10, 3 triangular pillars 11 are formed. Each of the pillars 11 is formed with a screw bolt 111 and a rubber sheath 112 set around the screw bolt 111 to form on the top of pillar 11 a head 113 of which the diameter is larger than that of pillar 11. On the blade 20 opposite to the pillar 11 of blade rack 10, three thru holes 21 are formed and set around the pillar 11 of blade rack 10 and lie below the head 113 of the pillar 11. Then, the holes 21 are wedged to the side of pillar 11 of the blade rack 10 through the locking plate 30 and located between the blade 20 and the head 113 of pillar 11 for fixing the blade 20 onto the blade rack 10.

Figure 2:
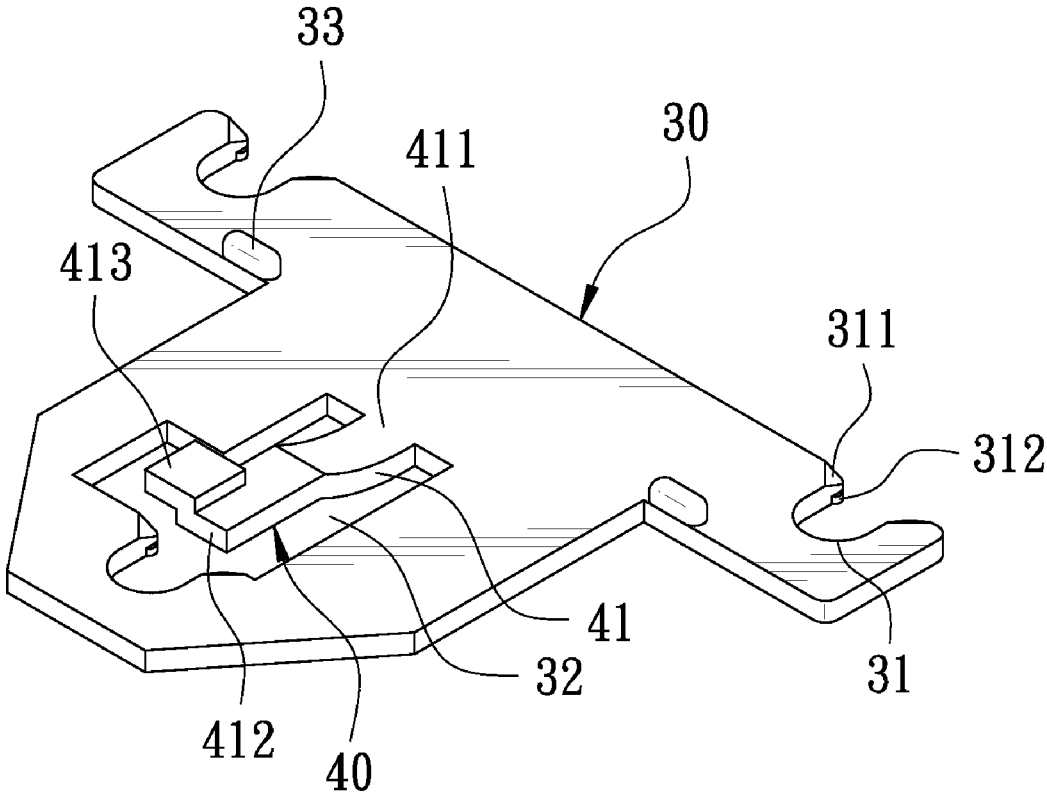
FIG. 2 is a 3D exploded view of a locking plate according to the present invention.

With reference to FIG. 2 shown as a 3D exploded view of a locking plate according to the present invention, three triangular nicks 31 are formed around the circumference of locking plate 30. A thru hole 32 is formed communicating with the open side of nick 31 in the center of locking plate 30. A wedge unit 40 is provided in the thru hole 32. The wedge unit 40 is a wedge spring plate 41. One side of the wedge spring plate 41 is a fixing terminal 411 and connects to the clamp plate 30; the other side is formed with a free terminal 412 upwards warping toward the open side of nick 31. The free terminal 412 lies at the open side of nick 31, where a convex portion stretches transversally. Further, an oblique angle 311 is formed at each of the two opening sides of the nicks 31 on the locking plate 30. A stop lump 312 is formed at a camber caused by the nicks 31 near the oblique angles 311. Next, a lug 33 is formed at the right and left sides of the thru hole 32 on the locking plate 30 for a user to easily apply a force to.

Figure 3:
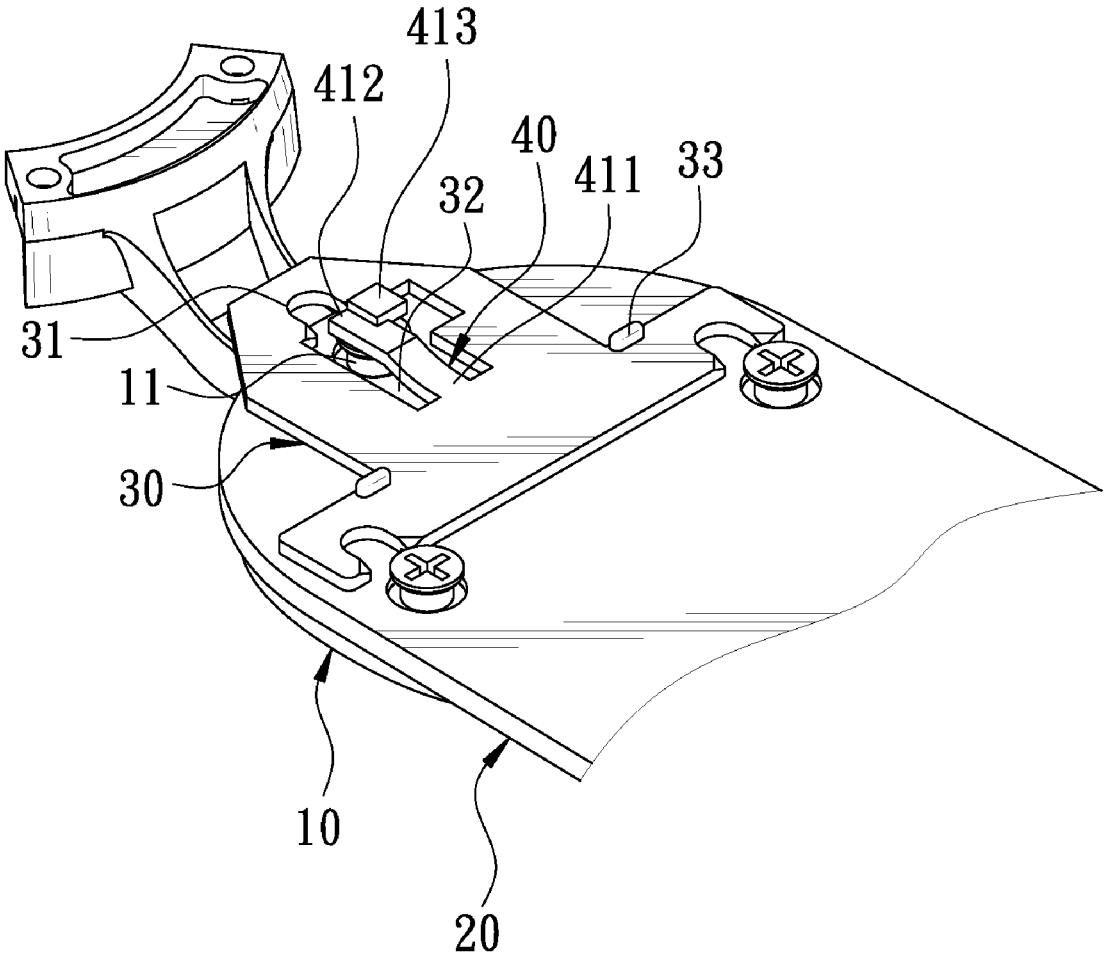
FIG. 3 is a schematic view illustrating a wedge spring plate of the locking plate according to the present invention does not stay close to the pillar of blade rack.
Figure 4:
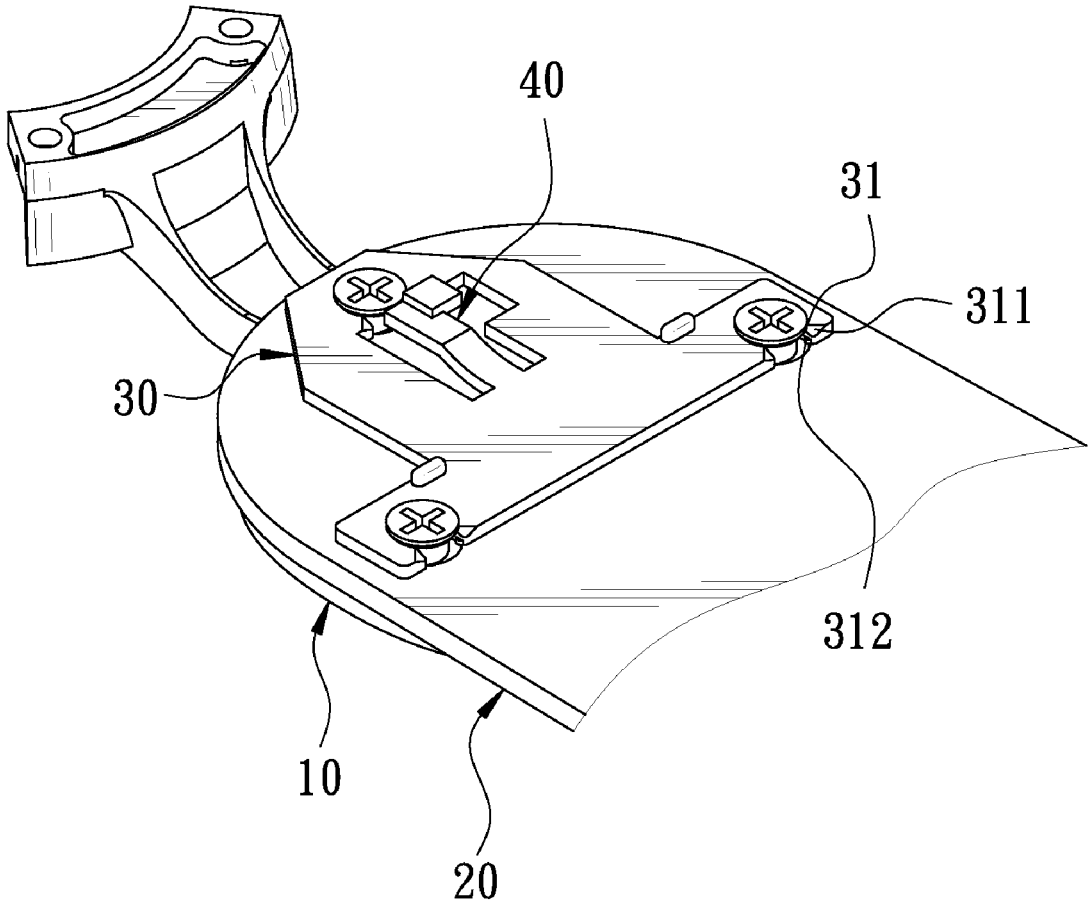
FIG. 4 is a schematic view illustrating a wedge spring plate of the locking plate according to the present invention stays close to the side of pillar of the blade rack.
Figure 5:
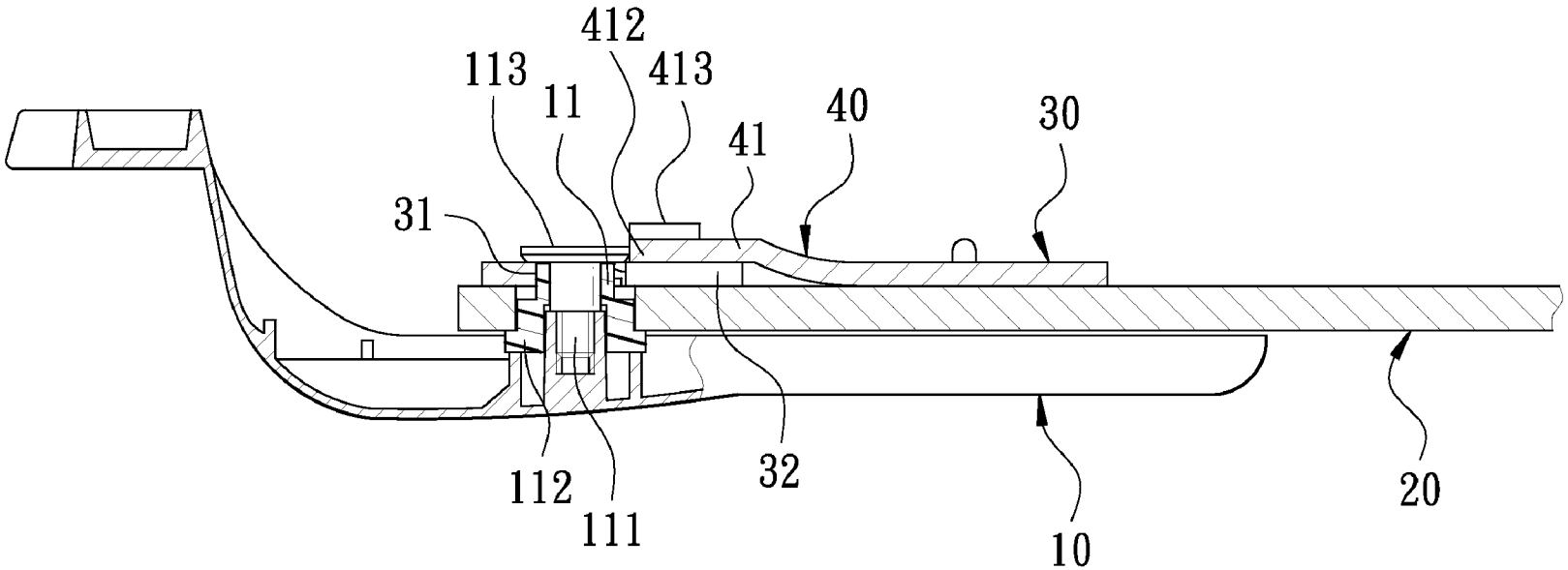
FIG. 5 is a sectional assembly view of the present invention.

Refer to FIGS. 3, 4, and 5 shown as a schematic view illustrating a service state of the present invention, and a sectional assembly view of this invention. Firstly, for completion of installation, as shown in FIG. 1, the aperture 21 of blade 20 is made to align with and be set around the pillar 11 of blade rack 10, and the nick 31 of locking plate 30 is made to align with and wedge to the opposite pillar 11 on the blade rack 10, thereby initial installation being completed, as shown in FIG. 3. The pillar 11 in the center of black rack 10 passes through the thru hole 32 of locking plate 30 and pushes upwards the wedge spring plate 41 to a range of a distance. Then, with the lugs 33, the locking plate 30 is shifted towards the pillars 11 of the blade rack 10. As shown in FIG. 4, with the oblique angle 311 at the two sides of opening of the nick 31 of locking plate 30, the first nick 31 of locking plate 30 is made to easily wedge forwards to the side of pillar 11 of blade rack 10. With the stop lump 312 on the inner wall of nick 31, the pillars 11 are not easily away from the nick 31. At this time, with reference to FIG. 5, the free terminal 412 of wedge spring plate 41 of the locking plate 30 shifts downwards to return with its elasticity, and stays close to the side of pillar 11 passing through the nick 31 communicating with the thru hole 32. Thus, the head 113 of pillar 11 is matched to fix the locking plate 30, and then the locking plate 30 is thereby blocked from moving for achievement of fixing of the blade 20 onto the blade rack 10. Accordingly, the blade 20 may be fast and exactly installed and the tremble and the wind shear sound caused by the blade not exactly located may be eliminated. Further, in order to remove the blade 20, only the convex portion 413 is used to pull up the wedge spring plate 41 and make the wedge spring plate 41 shift upwards and move away from the side of the pillar 11 in the nick 31 communicating with the thru hole 32; thus, the blade 20 may be operated in an inverse direction to be removed from the blade rack 10.

Figure 6:
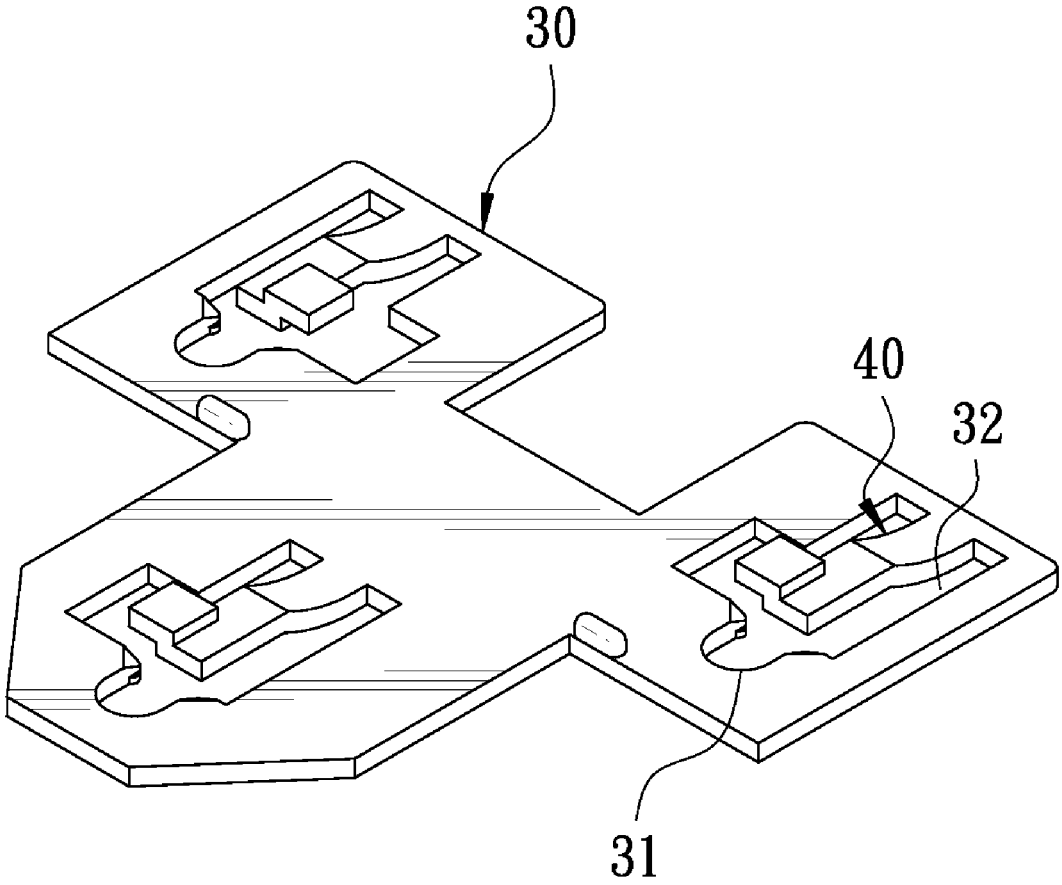
FIG. 6 is a 3D view of the locking plate in another preferred embodiment of the present invention.

With reference to FIG. 6 as a 3D view of the locking plate in another preferred embodiment of the present invention, the structure and principle of locking plate 30 is approximately the same as that in the preferred embodiment of the present invention, and what is different is in that a thru hole 32 is formed at the open side of each nick 31 of the locking plate 30 and a wedge unit 40 is provided in each of the thru holes 32. Thus, the locking plate 30 may be exactly and securely installed and fixed.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A locking plate fast fastening ceiling fan blades, the ceiling fan being provided with several blade racks and each blade rack fixing a blade by wedging a locking plate, in which several pillars are provided on each blade rack, a head of which the diameter is larger than that of pillar is provided at the top of each pillar, and on the blade opposite to the pillar of blade rack, thru holes are formed and set around the pillar of blade rack, being characterized in that:

the locking plate opposite to the pillar of blade rack is provided with several nicks and wedges to the side of the pillar and lies between the blade and the head of locking part, at least one thru hole is formed communicating with the open side of nick of the locking plate, at least one wedge unit is provided in the thru hole, the wedge unit is a wedge spring plate, one end of the wedge spring plate is a fixing terminal and connects to the locking plate, the other end facing towards the open side of nick is formed with a free terminal warping upwards, and the free terminal lies at the open side of nick to stay close to and pass through the pillar in the nick.

2. The locking plate fast fastening ceiling fan blades according to claim 1, wherein an oblique angle is formed at each of the two opening sides of the nicks on the locking plate.

3. The locking plate fast fastening ceiling fan blades according to claim 2, wherein the locking plate is formed with a stop lump at a camber formed by each nick near each oblique angle.

4. The locking plate fast fastening ceiling fan blades according to claim 1, wherein several lugs are further formed on the locking plate.

5. The locking plate fast fastening ceiling fan blades according to claim 1, wherein a convex portion stretches transversally on the free terminal of wedge spring plate.

* * * * *